US006182858B1

(12) United States Patent
Hartog

(10) Patent No.: US 6,182,858 B1
(45) Date of Patent: Feb. 6, 2001

(54) WET TOWEL DISPENSER

(76) Inventor: Lawrence Den Hartog, 1905 Country Club Dr., Grinnell, IA (US) 50112

( * ) Notice: Under 35 U.S.C. 154(b), the term of this patent shall be extended for 0 days.

(21) Appl. No.: 09/358,961

(22) Filed: Jul. 22, 1999

(51) Int. Cl.[7] ..... B65H 1/00
(52) U.S. Cl. ..... 221/63
(58) Field of Search ..... 221/63

(56) References Cited

U.S. PATENT DOCUMENTS

| | | | |
|---|---|---|---|
| 2,060,466 | 11/1936 | Gutenstein . | |
| 3,780,908 | 12/1973 | Fitzpatrick et al. . | |
| 3,784,055 | 1/1974 | Anderson . | |
| 3,836,044 | 9/1974 | Tilp et al. . | |
| 3,841,466 | 10/1974 | Hoffman et al. . | |
| 4,651,895 * | 3/1987 | Niske et al. | 221/63 |
| 4,735,317 | 4/1988 | Sussman et al. . | |
| 5,542,568 | 8/1996 | Julius . | |
| 5,699,912 | 12/1997 | Ishikawa et al. . | |
| 5,718,353 | 2/1998 | Kanfer et al. . | |

FOREIGN PATENT DOCUMENTS

| | | | |
|---|---|---|---|
| 7900371 * | 7/1980 | (NL) | 221/63 |

* cited by examiner

*Primary Examiner*—David H. Bollinger
(74) *Attorney, Agent, or Firm*—Zarley, McKee, Thomte, Voorhees & Sease

(57) ABSTRACT

A wet towel dispensing lid assembly includes an upper first wall portion pivotally connected to a lower wall of a chamber with the lower wall and first wall portion having opposing circular walls engagable in nesting relationship when the first wall portion is in its closed position. The opposed walls form a towel end tip well maintaining the towel end tip in a damp sealed accessible condition.

5 Claims, 4 Drawing Sheets

WET TOWEL DISPENSER

BACKGROUND OF THE INVENTION

A problem with wet towel dispensers is that the chemicals will evaporate polluting the atmosphere and rendering the towels ineffective for their intended cleaning purpose. What is needed is a wet towel dispenser which will maintain the towels in a sealed condition during storage, transport and use.

SUMMARY OF THE INVENTION

A roll of wet towels are stored in a cylindrical plastic container having an open upper end sealed closed by a plastic wafer or foil which may be punctured when towels are to be dispensed through a dispensing lid assembly threadably connected to the top of the container.

The dispensing lid assembly has upper and lower walls with the upper wall being formed by a pivotal first wall portion which cooperates with a second wall portion to define a chamber between the upper and lower walls. The first wall portion includes a downwardly extending cylindrical wall opposing an upwardly extending cylindrical wall on the chamber bottom wall. The oppositely extending walls meet in nesting relationship to form a tissue end tip well when the first upper wall portion is in a closed position. A dispensing opening is provided in the bottom chamber wall and is coaxial with the axial center of the towel container but is offset from the axial center of the towel end tip well thereby allowing the towel end tip to extend across the well and be confined therein when the first upper wall portion is in a closed position.

The upper wall first portion is spring biased to a closed position thus normally maintaining the opposing walls in the nesting relationship thereby sealing the towel end tip well when towels are not being dispensed.

It is important that towels be dispensed from the center of the container and that the towel end tip be accessible when a towel is needed but sealed in the end tip well when the dispenser is not being used.

DESCRIPTION OF THE PREFERRED EMBODIMENT

Figure 1:
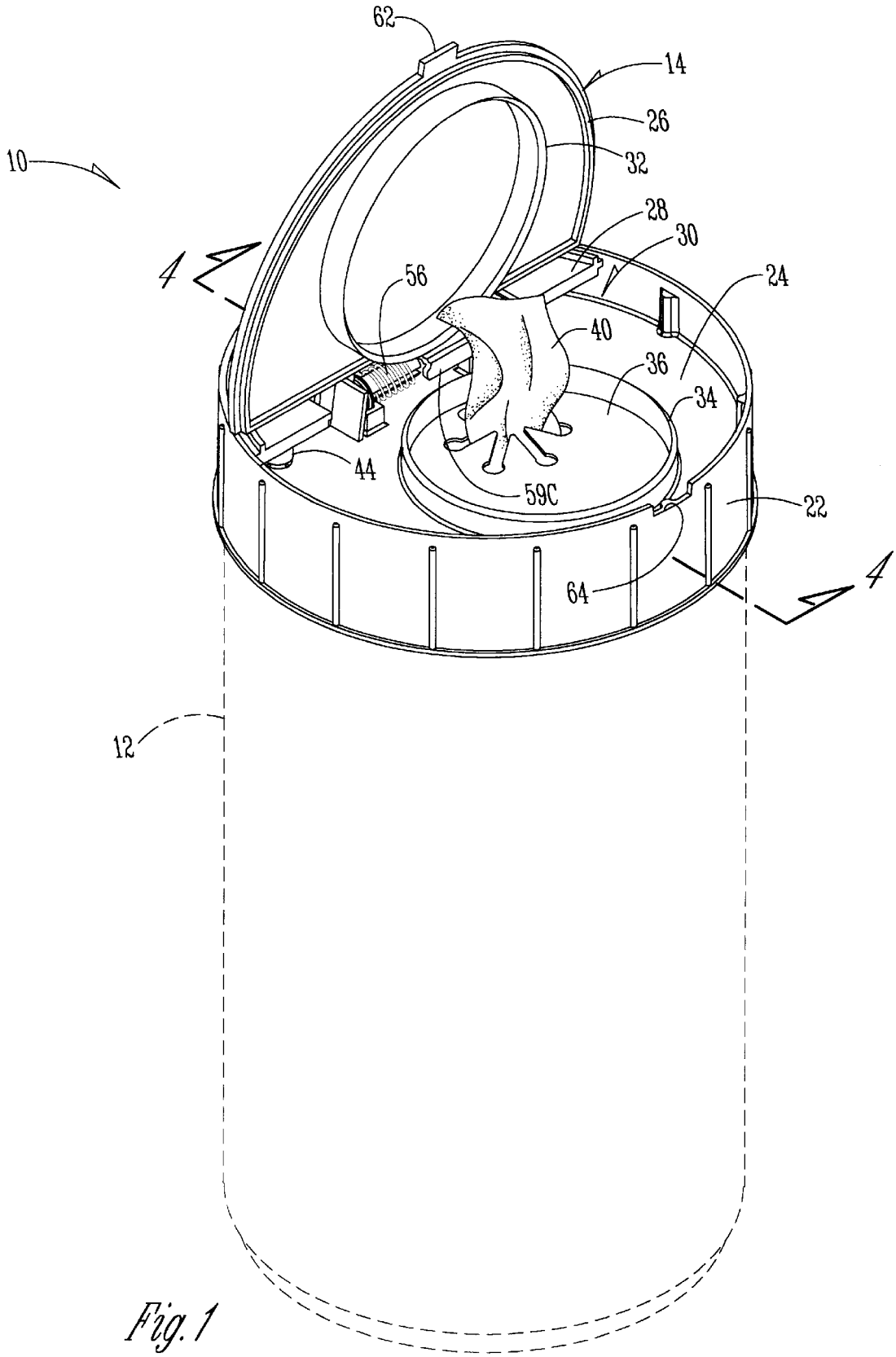
FIG. 1 is a front perspective fragmentary view of the wet towel dispenser of this invention showing the dispensing lid assembly in an open position and a wet towel end tip accessible for removing a towel from the container.

The tissue dispenser of this invention is generally referred to in FIG. 1 by the reference numeral 10 and includes a plastic cylindrical container 12 threadably engaging a dispensing lid assembly 14.

Wet towels stored in a roll are held in the container 12 and sealed by a plastic wafer 20 until punctured for dispensing towels at the job site.

The dispenser lid assembly 14 includes an outer cylindrical wall 22 which cooperates with a bottom wall 24 and first upper wall portion 26 and second stationary wall portion 28 to form a chamber 30.

The first upper wall portion 26 includes a circular wall 32 in opposing relationship with an upstanding circular wall 34 on the bottom wall 24 to define a well 36 when the walls 32 and 34 are in nesting relationship. The bottom wall 24 includes a towel dispensing opening 38 through which a towel end tip 40 extends making it accessible for use as seen in FIG. 1.

Figure 3:
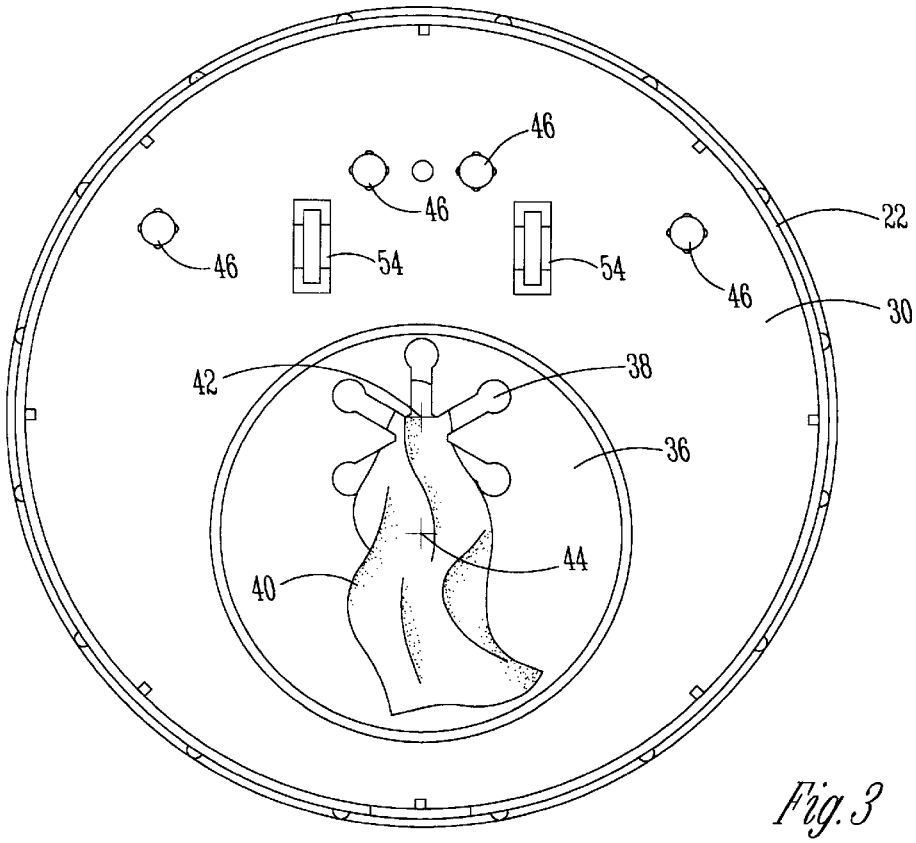
FIG. 3 is a top plan view with the upper first and second wall portions removed.
Figure 4:
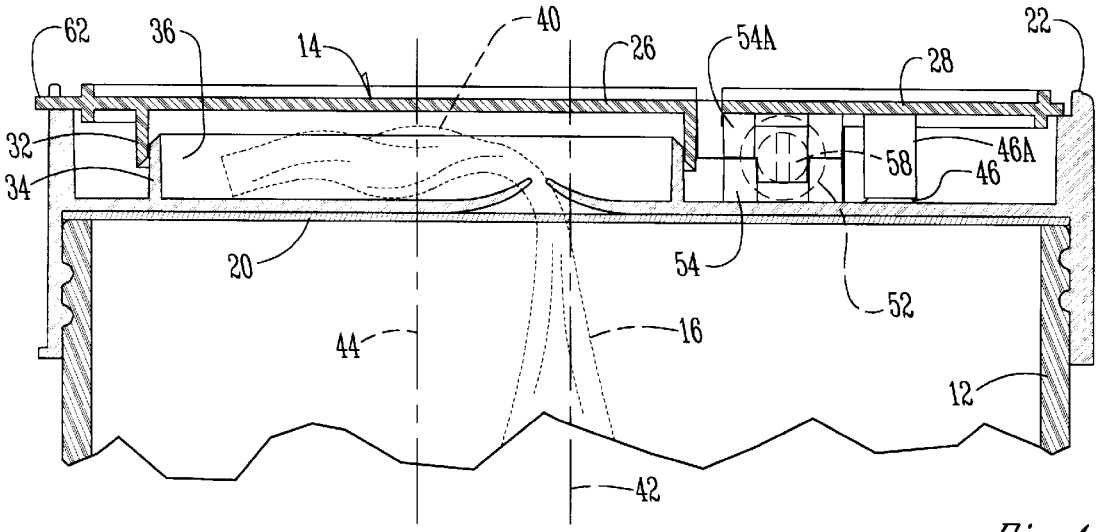
FIG. 4 is a cross sectional view taken along line 4—4 in FIG. 1 but showing the lid assembly in a closed condition and the towel end tip sealed within the well defined by the opposing nesting walls on the upper and lower walls of the dispensing lid assembly.
Figure 5:
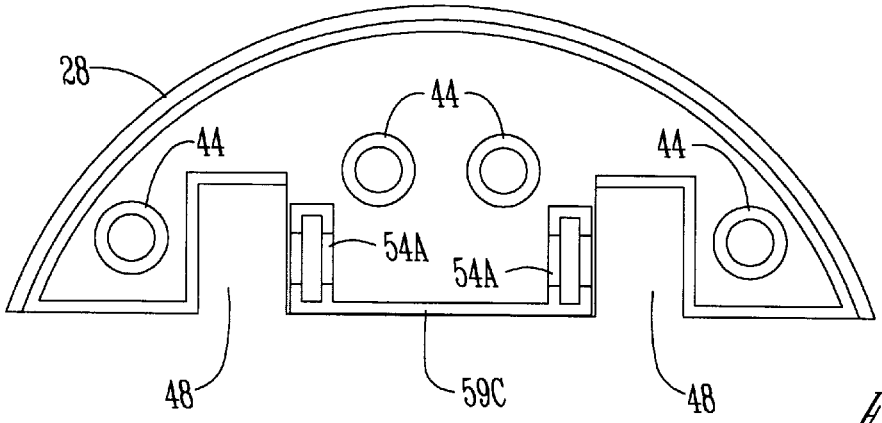
FIG. 5 is a bottom plan view of the stationary upper wall portion of the dispenser lid assembly.
Figure 6:
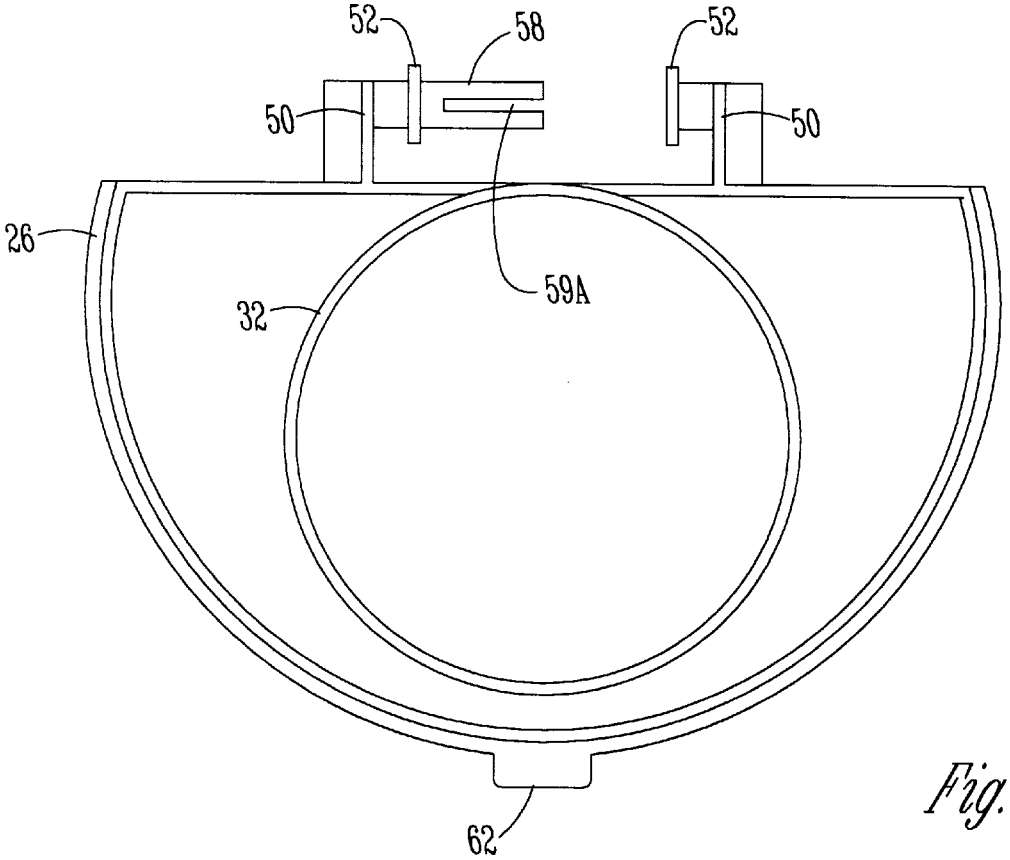
FIG. 6 is a bottom plan view of the pivotal wall portion of the dispenser lid assembly.

In FIG. 3 it is seen that the dispensing opening 38 and the container 12 have a center coaxial axis 42 offset from the center axis 44 of the well 36. It is seen in FIGS. 3 and 4 that the towel end tip 40 extends substantially across the width of the well 36 and is maintained in a sealed condition when the dispensing lid assembly 14 is closed as seen in FIG. 4.

Figure 2:
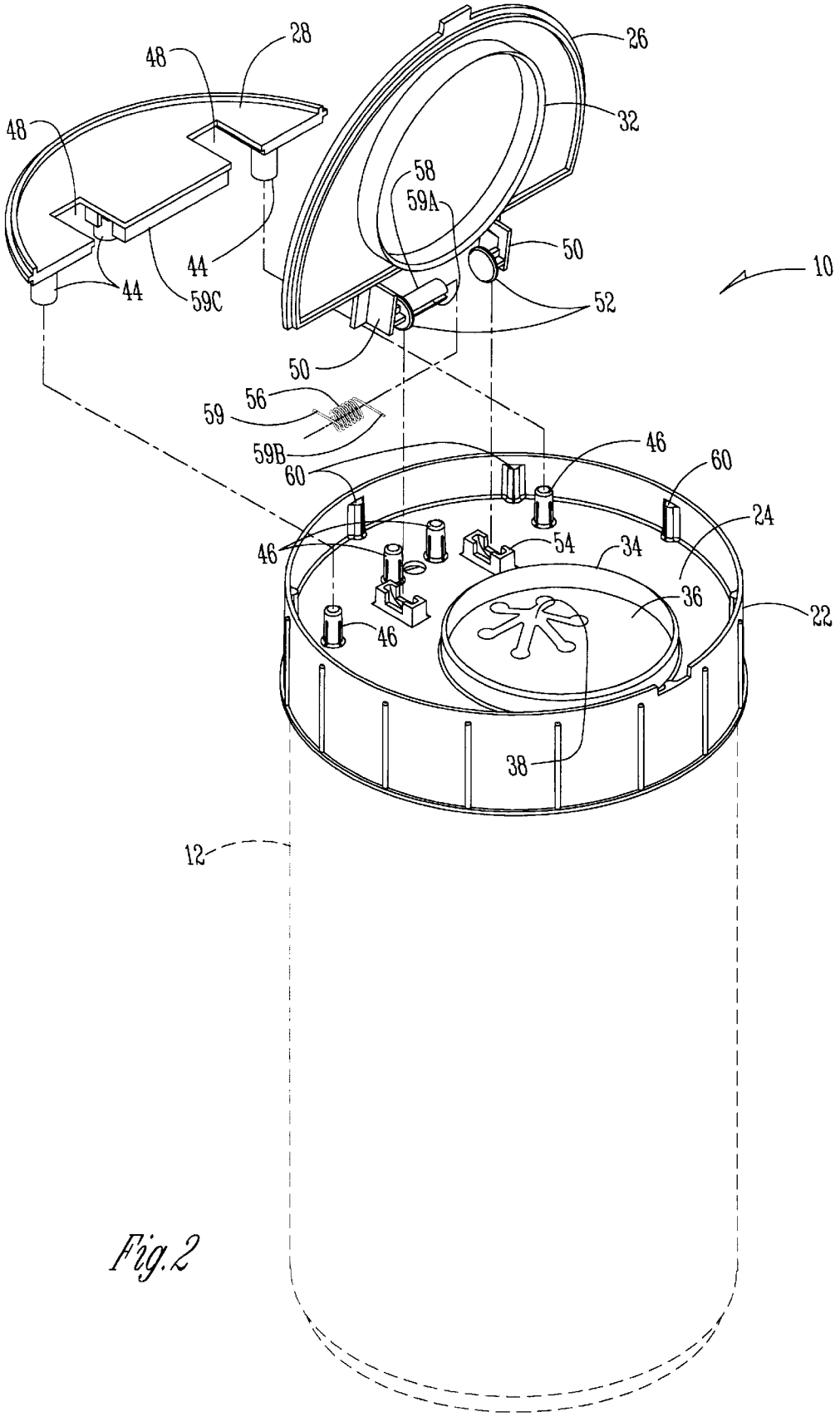
FIG. 2 is a front perspective view similar to FIG. 1 but showing the dispenser lid assembly in an exploded condition.

The second stationary wall portion 28 is semi-circular in shape and includes downwardly extending posts 44 engaging upwardly extending posts 46 on the bottom wall 24 of the chamber 30. Slots 48 are formed in the wall portion 28 to receive pivot arms 50 on the first wall portion 26. The arms 50 include circular disks 52 rotatably mounted in opposing bearing supports 54 and 54A to allow pivoting of the wall portion 26 between open and closed positions as seen in FIGS. 2 and 4 respectively.

The wall portion 26 is normally spring biased to a closed position by a coil spring 56 mounted on a stub shaft 58 and having one end 59 received in a slot 59A. The opposite end 59B of the spring 56 engages the bottom wall 36 under the upper wall portion 28. A wall 59C on the bottom side of the second upper wall portion 28 in FIG. 1 is broken away to show the spring 56.

Upstanding shoulders 60 are provided on the inside surface of the outer peripheral wall 22 to limit downward travel of the first wall portion 26 when in its closed position. A finger tab 62 on the first wall portion 26 is received in a notch 64 formed in the upper edge of the outer peripheral wall 22 as seen in FIG. 4.

It is thus seen through the use of the wet towel dispenser of this invention that the atmosphere is protected from undesirable chemicals, wet towels are maintained in their desired damp condition and a towel end tip is always accessible and damp in a towel end tip well in the dispensing lid assembly.

What is claimed is:

1. A wet towel dispenser comprising, a container having an open upper end, a dispensing lid assembly removably positioned on said container open upper end, said dispensing lid assembly including upper and lower walls interconnected by an outer peripheral wall defining a chamber, said upper and lower walls including oppositely extending walls adapted to engage each other in nesting relationship and defining a towel end tip well, said lower wall having a dispensing opening providing communication between said container and said towel end tip well, said upper wall including a wall portion pivotable between open and closed positions with said oppositely extending walls being in a said nesting relationship when said wall portion is pivoted to said closed position, and each of said container, tissue end tip well, and dispensing opening having axial centers with said dispensing opening and said container axial centers being substantially coaxial and said well axial center being off set therefrom whereby said towels may be dispensed from the center of the container and the tissue end tip may extend across the substantial end tip well and be confined therein.

2. The towel dispenser of claim 1 and said upper wall includes a second wall portion extending over a portion of said lower wall and being stationary and cooperating with said first wall portion to extend over the entirety of said lower wall when said first wall portion is in said closed position.

3. The towel dispenser of claim 2 and cooperating hinge means are provided on said first upper wall portion and said lower wall for pivoting said first wall portion between said open and closed positions.

4. The towel dispenser of claim 3 and said removable lid assembly is further defined as being threadably connected to said container through threads on said peripheral wall and said container.

5. The towel dispenser of claim 3 and said first upper wall portion is spring biased to said closed position.

* * * * *